US008089420B2

(12) United States Patent
Augustin

(10) Patent No.: US 8,089,420 B2
(45) Date of Patent: Jan. 3, 2012

(54) QUICK DEPLOYABLE DISASTER SATELLITE EARTH TERMINAL

(75) Inventor: Eugene P. Augustin, Orlando, FL (US)

(73) Assignee: Resilient Satellite Services, Los Angeles, CA (US)

( * ) Notice: Subject to any disclaimer, the term of this patent is extended or adjusted under 35 U.S.C. 154(b) by 303 days.

(21) Appl. No.: 11/734,002

(22) Filed: Apr. 11, 2007

(65) Prior Publication Data

US 2007/0296627 A1 Dec. 27, 2007

Related U.S. Application Data

(60) Provisional application No. 60/744,643, filed on Apr. 11, 2006.

(51) Int. Cl.
*H01Q 1/42* (2006.01)

(52) U.S. Cl. ..... 343/872

(58) Field of Classification Search ..... 343/872, 343/757–758, 761

See application file for complete search history.

(56) References Cited

U.S. PATENT DOCUMENTS

| | | | | |
|---|---|---|---|---|
| 4,198,639 | A * | 4/1980 | Killion | 343/727 |
| 4,312,002 | A | 1/1982 | Stewart | |
| 5,406,294 | A * | 4/1995 | Silvey et al. | 343/709 |
| 5,708,679 | A * | 1/1998 | Fernandes et al. | 375/259 |
| 6,191,753 | B1 * | 2/2001 | Ellis et al. | 343/872 |
| 6,297,710 | B1 * | 10/2001 | Cook et al. | 333/21 A |
| 6,933,908 | B1 | 8/2005 | Mirabueno | |
| 6,963,315 | B2 | 11/2005 | Gierow et al. | |
| 7,231,881 | B2 * | 6/2007 | Nelson | 114/211 |

OTHER PUBLICATIONS

International Search Report issued in PCT/US07/66399 dated Aug. 8, 2008.

* cited by examiner

*Primary Examiner* — Huedung Mancuso
(74) *Attorney, Agent, or Firm* — Baker & McKenzie LLP

(57) ABSTRACT

A communications system is provided, which includes a radome having a top portion, a bottom portion, a flanged mating area joining the top and bottom portion, and a means for lifting the radome at the flanged mating area. Methods of using are also disclosed.

24 Claims, 6 Drawing Sheets

100

100

QUICK DEPLOYABLE DISASTER SATELLITE EARTH TERMINAL

CROSS REFERENCE TO RELATED APPLICATIONS

This application claims priority to U.S. Provisional Application Ser. No. 60/744,643, filed Apr. 11, 2006, the entire contents of which are hereby incorporated by reference.

BACKGROUND

Field

The present invention relates to communication systems for emergency disaster communications that may be quickly deployed as a permanent addition to a communications infrastructure.

DESCRIPTION OF THE SEVERAL EMBODIMENTS

Figure 1:
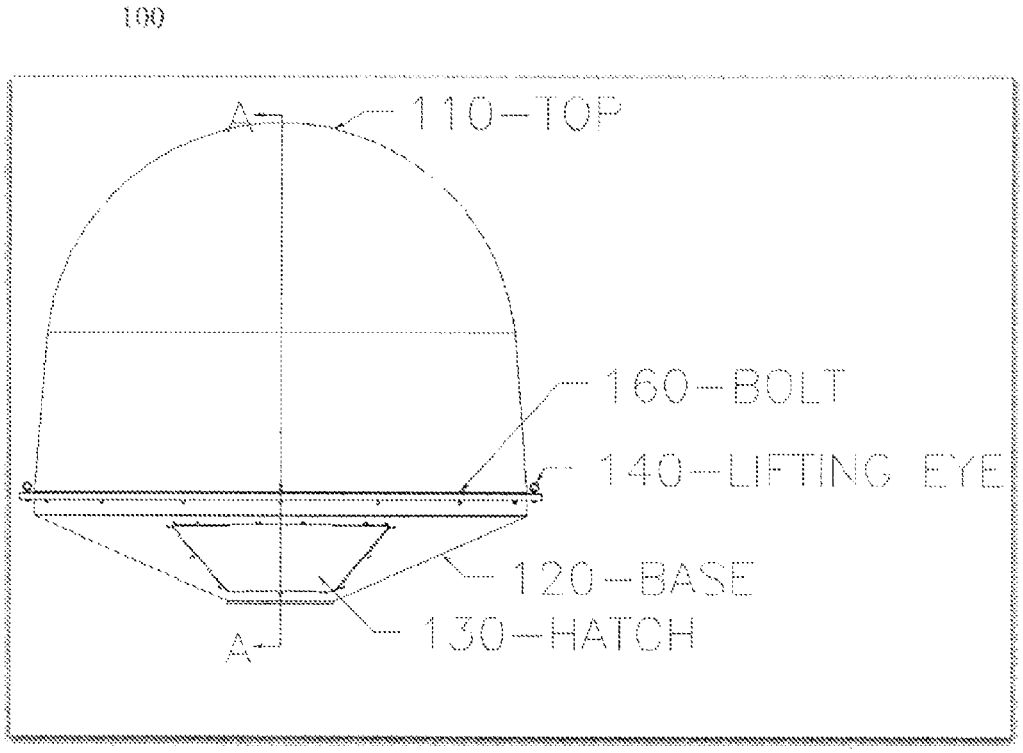
FIG. 1 shows a view of one embodiment of the radome according to an embodiment of the invention.

One embodiment generally relates to a communications system, that includes:

a radome having a top portion, a bottom portion, a flanged mating area joining the top and bottom portion, and a means for lifting the radome at the flanged mating area.

One embodiment provides a system for emergency disaster communications that can be quickly deployed.

One embodiment provides a system for emergency disaster communications that can be quickly and easily deployed as a permanent addition to a communications infrastructure.

In one embodiment, the system can be deployed, installed, and operating in 72 hours or less, which range includes all ranges and subranges therebetween, including 72, 48, 36, 24, 12, 8, 6, and 4 hours.

In one embodiment, once installed, the communications system can operate as a permanent addition to one or more communications infrastructures or networks for the lifetime of the infrastructure or network.

One embodiment of the present system has the advantage that it may be quickly and easily installed and thereafter operate as a permanent addition to the communications infrastructure or network. In one embodiment, the deployment and installation may be carried out in advance of a known event, such as an impending storm, for example. In another embodiment, the deployment and installation may be carried out in the absence of any precipitating event, but rather as a preparative or preventative measure in case an event might occur, such as a terrorist attack, for example. In another embodiment, the deployment and installation can be carried out in advance of a suspected or anticipated event, such as at the beginning of a hurricane or tornado season, for example.

One embodiment provides a system for emergency disaster communications that quickly prevents the loss of or restores communication systems for data, voice, and/or video over one or more satellite links.

one embodiment provides a system designed to operate during and/or after an emergency or disaster.

One embodiment provides a satellite earth terminal, for example, a small earth terminal, which is designed to withstand hurricane force winds and/or winds in the range of 200 mph.

One embodiment provides a system that reduces or eliminates entirely the loss of conventional communication systems such as telephone, radio, television, fax, and/or Internet communications, during an emergency or disaster.

One embodiment provides a system such that the effect of a disaster is not compounded by the lack of communication.

In conventional systems, wherein prior to disasters or on the eve of an impending disaster, a trained professional has to secure the earth terminal to prevent damage thereto from the disaster. Similarly, in such systems, after the disaster, the trained professional must go back to the site and restore communications. In these systems, communications are lost at the most critically needed time of a disaster.

One embodiment of the present invention relates to a satellite earth terminal system that may be quickly deployed prior to or immediately after a disaster. The system is designed to withstand the disastrous effects of hurricanes, tornadoes, and earthquakes. The system may be installed on a tower, building, vehicle, or vessel. It provides satellite communications, including data, voice, video and/or Internet before, during and after a disaster, maintaining critically needed essential communications.

One embodiment provides a radome 100 that houses and protects an antenna system 300 having the components of a satellite earth terminal. The antenna system 300 may include an antenna, antenna positioner, low noise amplifier, and block up-converter (not shown).

In one embodiment, the radome 100 includes an access hatch 130 and one or more lifting eyes 140. The lifting eyes 140 may optionally include one or more lifting straps. The access hatch 130 allows personnel to maintain the antenna system 300 if necessary. The lifting eyes 140 provide a convenient method for lifting the system for installation without damage. The lifting straps may be stored within the radome 100. The system is small and lightweight such that two persons can lift it manually or with a simple hand operated winch, for example, with one person operating the winch and the other using a guy line to guide the radome 100 during the lift.

In one embodiment, the lifting eyes 140 and/or straps may be used to secure the system, e.g., acting as tie downs.

In one embodiment, the radome 100 includes a top section 110, a base section 120 and a hatch 130. The top section 110 and the base section 120 are joined in an overlapping flange 150 on the top section that overlaps the flange 170 on the base section. The top and the base are secured to each other by a series of bolts and nuts 160, and lifting eyes 140 through the flanges.

The radome top section 110 is designed to minimize the effect on RF energy passing through the radome 100. This design may depend upon several factors, including, for example, the operating frequency band, the range of angles of incidence that rays emanating from the normal to the aperture of the antenna in the direction of propagation of the RF energy, dielectric properties of the materials, and method of construction. Radome RF design is well documented in Massachusetts Institute of Technology Radiation Laboratory Series, Volume 26, the entire contents of which are hereby incorporated by reference. These principles are applied to the radome 100 with consideration for structural properties to achieve a design that will withstand 200 mph winds with rain and hail.

The base 120 of the radome may be designed for structural strength and/or without regard for RF properties. In one embodiment, none of the RF energy of the antenna system 300 passes through the base 120. In this manner, the antenna 300 inside the radome 100 is not affected by the happenings outside the radome 100 since the antenna 300 is mounted securely to the base 120 of the radome 100. Moderate flexing of the radome 100 or radome top 110 has no effect on the performance of the antenna 300 within the radome 100.

The top 110 is in the shape of a hemisphere atop a cylinder with a flange at the base. This shape presents essentially a constant range of angles of incidence for all elevation angles above the horizon, independent of azimuth angle.

The base 120 has a mating flange 170 that mates with the mating flange 150 of the top such that the two parts of the top 110 and base 120 can be joined using series of bolts 160 and lifting eyes 140 around the flange. The flange 170 connects to the conical base 120 with a bottom area 180. In one embodiment, the bottom area 180 is flat. In another embodiment, the bottom area 180 is configured to mount upon a pole, tower, rooftop, or other supporting structure. In one embodiment, the bottom area 180 is the interface for the antenna system 300 within the radome 100 and for mounting the radome 100 to the supporting structure.

In one embodiment, the radome 100 is mounted to a non-penetrating support, for example, those manufactured by Baird Satellite Support Systems.

An access hatch 130 is provided in the conical section of the base 120 that allows personnel to have access to the interior of the radome 100 for maintenance or other purposes. The hatch 130 may be positioned anywhere on the base so long as it does not interfere with the projected aperture of the antenna system 300. In one embodiment, the hatch 130 is positioned opposite the antenna system 300 such that it does not interfere with the projected aperture of the antenna. In one embodiment, when the system is viewed from overhead, in plan view, the projected aperture of the antenna is 180° from a centerline of hatch 130. In another embodiment, the hatch 130 may be positioned relative to the projected aperture, in plan view, such that an angle of 45-180° is formed therebetween. This range includes all values and subranges therebetween, including 45, 50, 60, 70, 80, 90, 100, 110, 120, 130, 140, 150, 160, 170, and 180°.

A lifting strap may be provided for each lifting bolt. A shackle may be provided so that all of the lifting straps can be joined into a single lift point above the top of the radome 100. A guide wire or rope can be temporarily attached to one of the lifting bolts to guide the assembly during lifting.

A flexible gasket may be located between the top 110 and bottom 120 as well as between the bottom 120 and the hatch 130 to provide a weather seal for the radome 100.

In one embodiment, the radome 100 has a complete antenna system 300 set up inside prior to installation at a location. In another embodiment, the radome 100 may be separated into its component pieces for ease of installation.

In one embodiment, the radome 100 is land based, and is not mobile or sea based.

In one embodiment, a light 200 is mounted on the radome 100. The light 200 may be mounted anywhere on the top 110, base 120, flange 150, 170, hatch 130, or any combination of these. In one embodiment, the light is mounted on a side portion of the radome 100, for example, on or near the flange 150, 170, such that it does not interfere with the RF signal to or from the antenna system 300.

In one embodiment, the light 200 is mounted on the same side of the radome 100 as the hatch 130. In one embodiment, the light 200 is positioned opposite the antenna system 300 such that it does not interfere with the projected aperture of the antenna. In one embodiment, when the system is viewed from overhead in plan view, the projected aperture of the antenna is 180° from the light 200. In another embodiment, the light 200 may be positioned relative to the projected aperture, in plane view, such that an angle of 45-180° is formed therebetween. This range includes all values and subranges therebetween, including 45, 50, 60, 70, 80, 90, 100, 110, 120, 130, 140, 150, 160, 170, and 180°.

Figure 2:
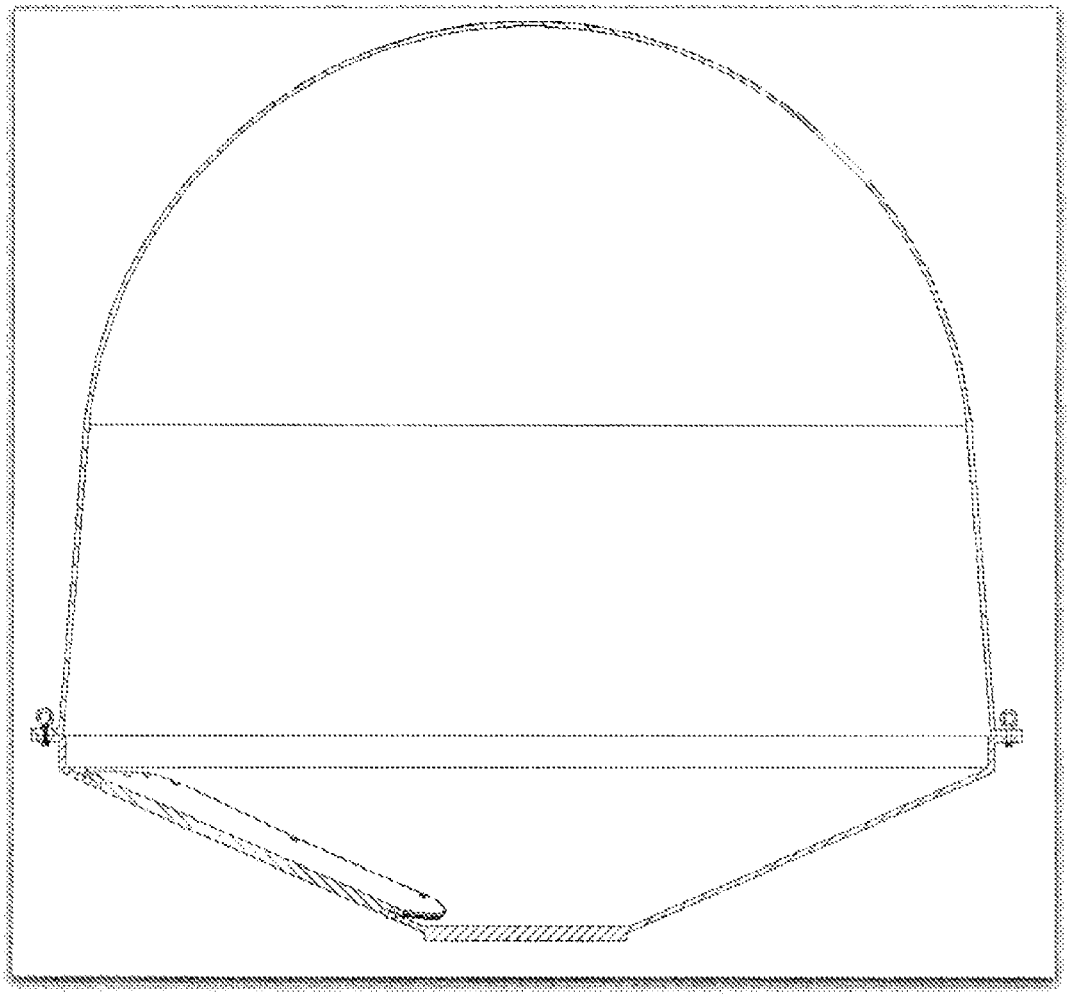
FIG. 2 shows a cross sectional view of the radome of FIG. 1 taken along the line A-A.
Figure 3:
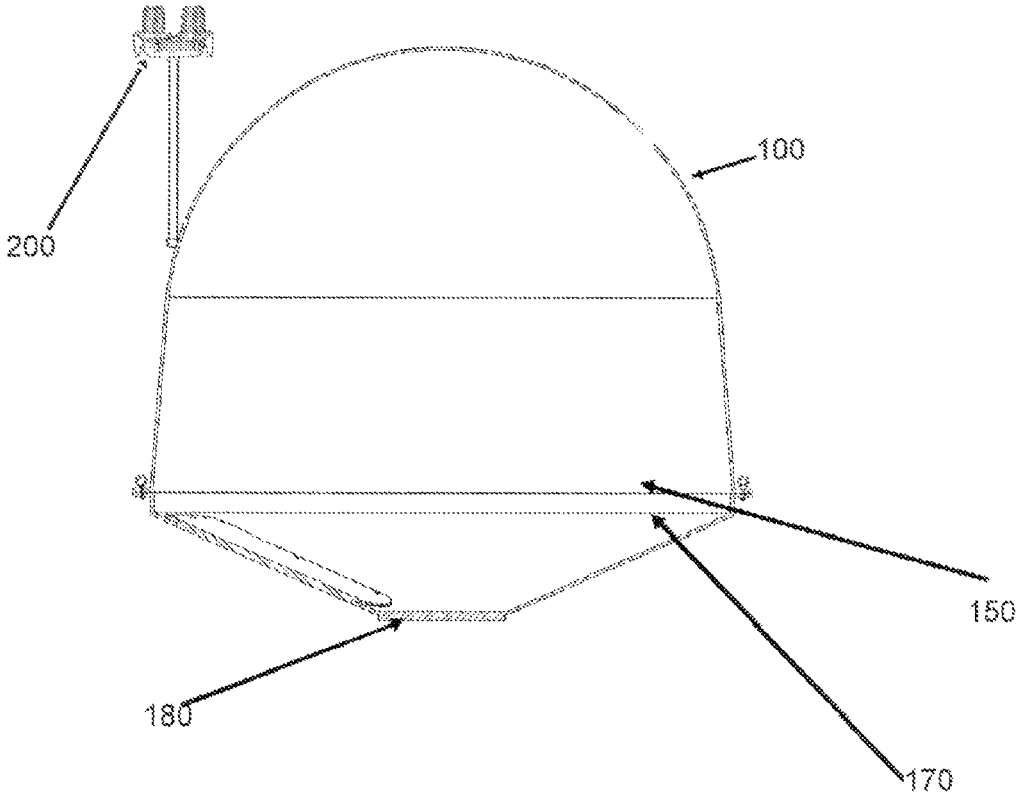
FIG. 3 shows an alternate embodiment of radome 100, in which a light 200 and bottom area 180 are shown.
Figure 4:
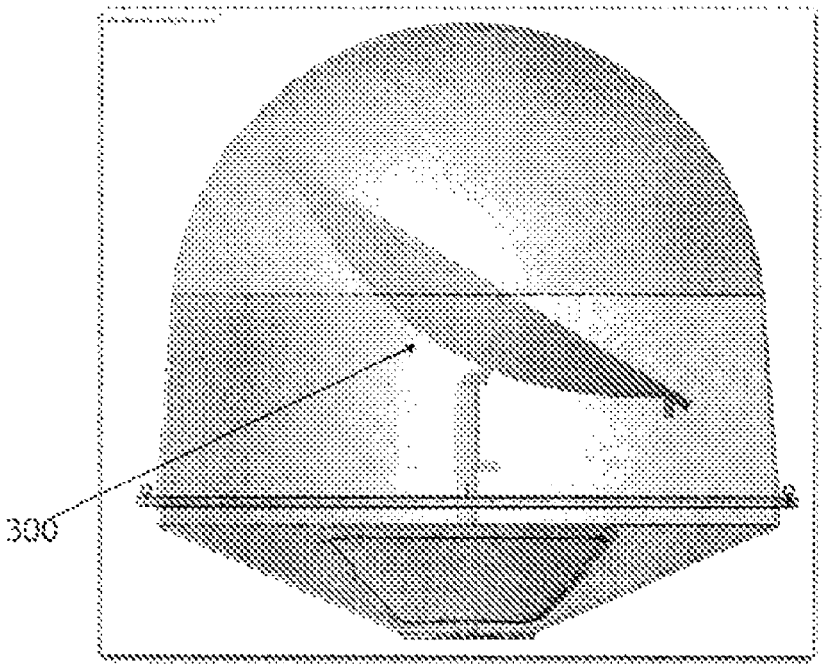
FIG. 4 shows an embodiment in which an antenna 300 is shown in the interior of the radome 100.
Figure 5:
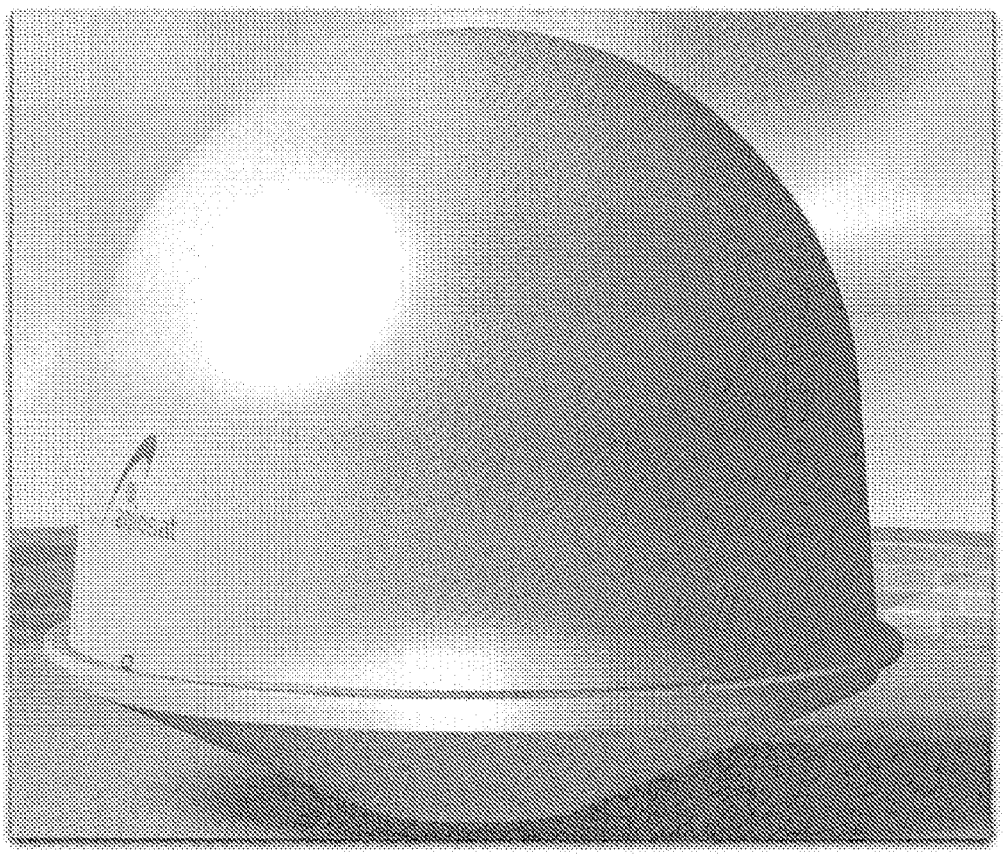
FIG. 5 shows a perspective view of one embodiment.
Figure 6:
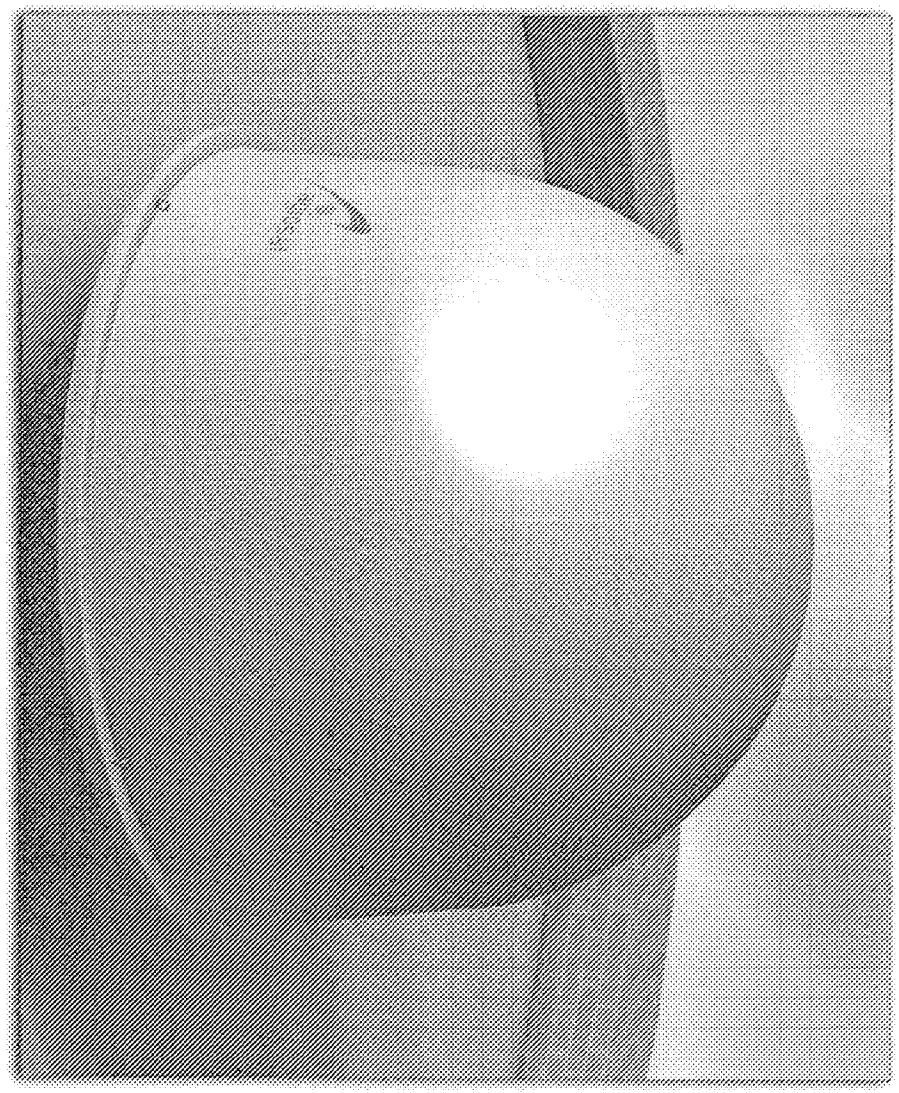
FIG. 6 shows a perspective view of one embodiment.

Similarly, when the system is viewed from the side, in elevation view such as in FIG. 2, the light 200 may be mounted anywhere on the top portion 110 of the radome 100 so long as it does not intersect with the projected aperture of the antenna. In one embodiment, the light 200 is mounted such that it projects higher than the uppermost point of the radome 100 when installed. In this embodiment, the light 200 is suitable to warn aircraft or aid in navigation.

In one embodiment, the antenna system 300 is a VSAT (very small aperture terminal). In one embodiment, the antenna system 300 is a USAT (ultra small aperture terminal).

In one embodiment, the antenna system 300 is a VSAT that interfaces with one or more global networks. In one embodiment, the VSAT provides one or more of voice, data, and/or Internet telecommunications. The VSAT may be one-way or two-way. It may transmit only, receive only, or transmit and receive.

One embodiment provides a system in which one or more radome(s) 100 and VSAT antenna system 300 are used in a star, mesh or point to point network.

In one embodiment, the antenna system 300 has a size ranging from 55 cm to 9 m. This includes all sizes there between, including 55 cm, 2 m, 3.8 m, 7.8 m, and 9 m.

The antenna system 300 may transmit and/or receive signals in the Ka band, Ku band, X band, or C band, or any combination thereof.

The antenna system 300 may have a size less than or equal to 3.8 m in Ku band embodiments and less than or equal to 7.8 m in C band embodiments.

In one embodiment, a system is provided having a VSAT network that includes a large high performance hub earth station (with an antenna of up to 9 m in diameter) and a large number of smaller, lower performance terminals, each using a radome 100.

The present system is particularly suited for interactive VSAT networks and one or more applications selected from the group including computer communications; reservation systems; database enquiries; billing systems; file transfers; electronic mail; video conferencing; point of sale transactions; credit checks and credit card verification; stock control and management; emergency communications; military applications; Federal Emergency Management Administration (FEMA); National Oceanographic and Atmospheric Administration (NOAA); storm communication; storm response; hurricane communication; hurricane evacuation; hurricane response; tornado communication; tornado evacuation; tornado response.

In one embodiment, the VSAT configuration is a TDM/TDMA star network, having a high bit rate outbound carrier (TDM) from the hub to the remote earth stations, and one or more low or medium bit rate Time Division Multiple Access (TDMA) inbound carriers.

In one embodiment, in addition to the antenna system 300, one or more communication devices may be present in the interior portion of the communications system. Examples of these devices include GSM terminal, emergency radio, police radio, fire radio, wireless LAN, or a combination thereof.

In one embodiment, the antenna 300 is not stabilized. In one embodiment, the antenna 300 is stabilized.

What is claimed is:

1. A communications system, comprising:

a radome having a top portion having a first flanged end, a dome end, and a cylindrical body connecting the dome end to the first flanged end, the cylindrical body having a dome end diameter and a flanged end diameter, wherein the dome end diameter is equal to or less than the flanged end diameter, a truncated conical bottom portion having a first truncated end and a second flanged end adapted to mate with the first flanged end of the top portion to form a flanged mating area, and a lifting portion operable to lift the radome at the flanged mating area;

wherein the first truncated end of the bottom portion is adapted for mounting to a support structure.

2. The communications system of claim 1, wherein the lifting portion comprises one or more lifting straps or lifting eyes at the flanged mating area.

3. The communications system of claim 1, further comprising an interior portion within the radome defined by the top portion and bottom portion, and further comprising an antenna in said interior portion.

4. The communications system of claim 3, wherein the antenna is a VSAT.

5. The communications system of claim 3, wherein the antenna is a USAT.

6. The communications system of claim 3, further comprising at least one communication device selected from the group consisting of GSM terminal, emergency radio, police radio, fire radio, wireless LAN, and a combination thereof.

7. The communications system of claim 1, wherein the system is a land based system.

8. The communications system of claim 1, wherein the system is configured for at least one signal selected from the group consisting of data, voice, video, telephone, radio, television, fax, Internet communication, and a combination thereof.

9. The communications system of claim 1, wherein the system is configured for communication over one or more satellite links.

10. The communications system of claim 1, which is configured to withstand winds of 200 mph or higher without loss of communication.

11. A satellite earth terminal, comprising the communication system of claim 1.

12. A method for maintaining or establishing communication, comprising installing the communications system of claim 1 on a land based support.

13. The method of claim 12, wherein the land based support is selected from the group consisting of tower, building, pole, surface, and a combination thereof.

14. A method of establishing communication at a location, comprising deploying the communications system of claim 1 to the location.

15. A method for enhancing the safety of communication personnel in an emergency or disaster, comprising deploying the communication system of claim 1 in advance of the emergency or disaster.

16. A method, comprising lifting or lowering the communications system of claim 1.

17. The communication system of claim 1, wherein the bottom portion has a hatch formed therein.

18. The communications system of claim 17, wherein the first truncated end of the truncated conical bottom portion comprises a conical section and a base, and wherein the hatch is provided in the conical section.

19. The communications system of claim 1, wherein the first flanged end extends radially outward from the cylindrical body of the top portion, and the second flanged end extends radially outward from the truncated conical bottom portion, and wherein the dome end diameter is less than the flanged end diameter, and wherein the flanged end diameter is less than the diameter of the first flanged end.

20. The communications system of claim 19, wherein the lifting portion comprises a lifting eye that extends through the first flanged end and the second flanged end.

21. A method for preventing or restoring loss of communication during an emergency or disaster, comprising protecting an antenna with a communications system, said communications system comprising:

a radome having a top portion having a first flanged end, a dome end, and a cylindrical body connecting the dome end to the first flanged end, the cylindrical body having a dome end diameter and a flanged end diameter, wherein the dome end diameter is equal to or less than the flanged end diameter, a truncated conical bottom portion having a first truncated end and a second flanged end adapted to mate with the first flanged end of the top portion to form a flanged mating area, and a lifting portion operable to lift the radome at the flanged mating area; wherein the first truncated end of the bottom portion is adapted for mounting to a support structure.

22. The method of claim 21, further comprising transmitting or receiving one or more electromagnetic signal with the antenna.

23. The method of claim 21, wherein the emergency or disaster is selected from the group consisting of natural disaster, man made disaster, military emergency, state of emergency, government emergency, high winds, tornado, hurricane, thunderstorm, flood, tsunami, and a combination thereof.

24. A method for mitigating the effects of an emergency or disaster, comprising transmitting or receiving one or more electromagnetic signals with a communications system, the communications system comprising;

an antenna, and, surrounding the antenna, a radome having a top portion having a first flanged end, a dome end, and a cylindrical body connecting the dome end to the first flanged end, the cylindrical body having a dome end diameter and a flanged end diameter, wherein the dome end diameter is equal to or less than the flanged end diameter, a truncated conical bottom portion having a first truncated end and a second flanged end adapted to mate with the first flanged end of the top portion to form a flanged mating area, and a lifting portion operable to lift the radome at the flanged mating area;

wherein the first truncated end of the bottom portion is adapted for mounting to a support structure.

* * * * *